United States Patent [19]

Biffle

[11] 4,154,448

[45] May 15, 1979

[54] ROTATING BLOWOUT PREVENTOR WITH RIGID WASHPIPE

[76] Inventor: Morris S. Biffle, 800 W. Front, Midland, Tex. 79701

[21] Appl. No.: 843,291

[22] Filed: Oct. 18, 1977

[51] Int. Cl.[2] ..... F16J 15/56; E21B 33/03

[52] U.S. Cl. ..... 277/31; 251/1 B; 277/2

[58] Field of Search ..... 277/30, 31, 20, 1, 2; 251/1 R, 1 B

[56] References Cited

U.S. PATENT DOCUMENTS

| | | | |
|---|---|---|---|
| 2,071,197 | 2/1937 | Burns et al. | 251/1 B X |
| 2,303,090 | 11/1942 | Pranger et al. | 277/31 |
| 3,387,851 | 6/1968 | Cugini | 277/31 X |

FOREIGN PATENT DOCUMENTS

| | | | |
|---|---|---|---|
| 59469 | 6/1947 | Netherlands | 277/31 |
| 1014460 | 12/1965 | United Kingdom | 251/1 B |

*Primary Examiner*—Robert S. Ward, Jr.
*Attorney, Agent, or Firm*—Marcus L. Bates

[57] ABSTRACT

A rotating blowout preventor of simplified construction which requires no kelly drive bushing, and which has a rotating external housing formed at the upper marginal end thereof within which the main bearings and seals are isolated. The external housing rotates about a fixed washpipe and supports a stripper seal doughnut to which a stripper seal is mounted in underlying relationship thereto. A removal clamp enables the doughnut and stripper rubber to be lifted free of the assembly for service or replacement. The bearing housing is fabricated in a manner to enable servicing the seals and bearings thereof without removing the blowout preventor from the top of a tool string. The bearing housing and seals therefore are arranged respective to the rotating stripper rubber such that should leakage across the stripper rubber and seal occur, the isolated bearing housing will be maintained free of contamination therefrom.

17 Claims, 5 Drawing Figures

ROTATING BLOWOUT PREVENTOR WITH RIGID WASHPIPE

BACKGROUND OF THE INVENTION

Rotating blowout preventors form a critical part of a tool string for the reason that mud is circulated into and out of the borehole in conjunction therewith and accordingly, it is important that the rotating blowout preventor be able to function properly under continuous duty for several weeks while a borehole is being formed.

In drilling deep wells it is extremely expensive to shut a rig down and therefore great emphasis is placed upon the ability to field repair or field replace equipment, such as blowout preventors, at the drilling rig with a minimum of down time being involved.

Rotating blowout preventors of the prior art generally require that the entire assembly be lifted in a telescoping manner free of the turn table and kelly in order to replace any component parts thereof including the stripper rubber or stripper seal. Should the bearings or seals require servicing, it is generally necessary to carry the rotating blowout preventor into a service shop and accordingly, a considerable amount of down time is involved before the drilling operation can be resumed.

Accordingly, it would be desirable to be able to replace the stripper rubber or the stripper seal associated therewith without having to remove the entire rotating blowout preventor from the tool string. It would furthermore be desirable to be able to replace the bearings and bearing seals thereof without having to unbolt the massive blowout preventor and transport the blowout preventor to a service shop. More especially it would be desirable to have a rotating blowout preventor which normally could endure the abuse of drilling an entire borehole before the apparatus requires servicing.

It would also be desirable to have made available a rotating blowout preventor which eliminates the troublesome kelly drive bushing.

These desirable attributes are the subject of the present invention.

SUMMARY OF THE INVENTION

A rotating blowout preventor which is driven by a stripper rubber assembly and which can be completely rebuilt without removing the apparatus from a tool string. The stripper rubber assembly of the rotating blowout preventor slidably receives a driving member therethrough which rotates all of the moving parts thereof with respect to a main body, thereby eliminating the kelly drive bushing. The stripper rubber assembly is located at the upper marginal inner end of a fixed washpipe and can be rapidly removed from the main body by merely unbolting a clamp and withdrawing the assembly in an upward direction whereupon a new stripper rubber can be added to the assembly.

The rotating blowout preventor includes an external rotating housing within which spaced seals and bearings are located so that the seals and the bearings are completely isolated from high pressure fluids and therefore enjoy an unexpected long life. The seals and bearings can be replaced without removing the main body from the tool string.

The rubber stripper assembly is therefore removably received within and forms part of the upper marginal end portion of the rotating blowout preventor. The rotating head includes a downwardly directed, rotating, outer cylindrical skirt which forms part of the rotating housing, and which is spaced from an upwardly directed, inner fixed skirt which forms the fixed washpipe, and which cooperates together to form a bearing and seal chamber therebetween. The bearing and seal chamber is closed at each end by a seal means, and a slinger ring is superimposed over the uppermost of the seal means. The stripper rubber assembly includes a mounting doughnut, and a stripper seal means is interposed between the mounting doughnut and the washpipe so that any leakage across the seal means of the stripper assembly is directed through a series of radial ports located above the slinger ring to cause fluid leakage to flow across the top of the isolated bearing and seal chamber and away from the rotating blowout preventor.

A primary object of the present invention is the provision of a rotating blowout preventor which can be completely overhauled without removing the apparatuus from a tool string.

Another object of the invention is the provision of a rotating blowout preventor which does not require a kelly bushing drive, and which includes an external bearing and seal chamber completely isolated from drilling fluids which flow through the axial passageway of the apparatus.

A further object of this invention is the provision of a rotating blowout preventor in combination with a rubber seal assembly which rotates the apparatus, and which can be easily and rapidly removed from the main body thereof for servicing.

Another and still further object of this invention is the provision of a rotating blowout preventor which is efficient in operation, reliable in service, low in cost, and which includes a minimum of parts.

An additional object of this invention is the provision of a rotating blowout preventor which is lubricated in a novel manner.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
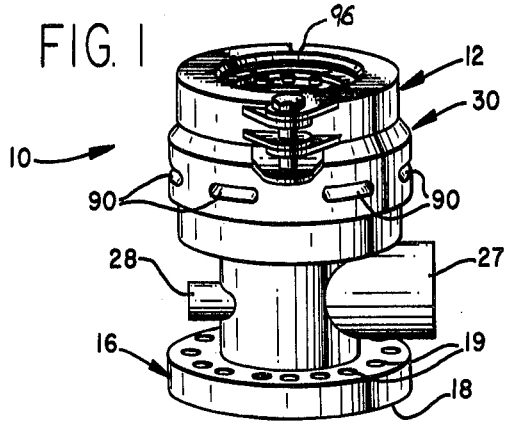
FIG. 1 is a perspective view of a rotating blowout preventor made in accordance with the present invention.

Throughout the various figures of the drawings, wherever it is possible or practical to do so, like or similar numerals will refer to like or similar objects. As seen in the various figures of the drawings, the rotating blowout preventor of the present invention is generally denoted by the numeral 10 and includes an uppermost end portion 12, in the form of a removable clamp, with the clamp having an upper face 14. The lower end of the rotating blowout preventor is in the form of a flange 16 having a lowermost end or face 18 and a bolt circle 19 which enables the apparatus of the present invention to be bolted to a tool string, otherwise known as a stack of equipment, with the apparatus of the present invention being the topmost tool of the stack.

A main body member 20 has a constant diameter, longitudinal axial passageway at 22 to form the illustrated upwardly directed fixed washpipe which terminates in a free end 24. The upper, outer marginal end of the washpipe is provided with a threaded surface 26. The threaded surface is right handed at the upper marginal end and left handed at the lower marginal end thereof for a purpose which will be better appreciated later on as this disclosure is more fully digested.

A main outlet 27 conducts fluid flow away from the borehole annulus while an auxiliary connection 28 is provided for whatever purpose one may wish to use it for.

A rotating head assembly 30 is grooved circumferentially for 320° at 32 and outwardly extends into a boss or flange 33 before turning downward into a bell-like circumferentially extending skirt member. A circumferentially extending lip 34 is received within the complementary groove of the before mentioned clamp 12, while the lower lip of the clamp is received within groove 32.

A stripper rubber assembly 36, which forms a subcombination of the present invention, includes a doughnut 38 by which the entire stripper assembly, which includes the doughnut and rubber, is removably mounted in fixed relationship respective to the rotating head assembly. The doughnut is provided with a circular boss 40 which inwardly tapers in a cone-like manner at 41 so that it is tightly and easily received in seated and aligned relationship respective to the remainder of the rotating head assembly.

Figure 2:
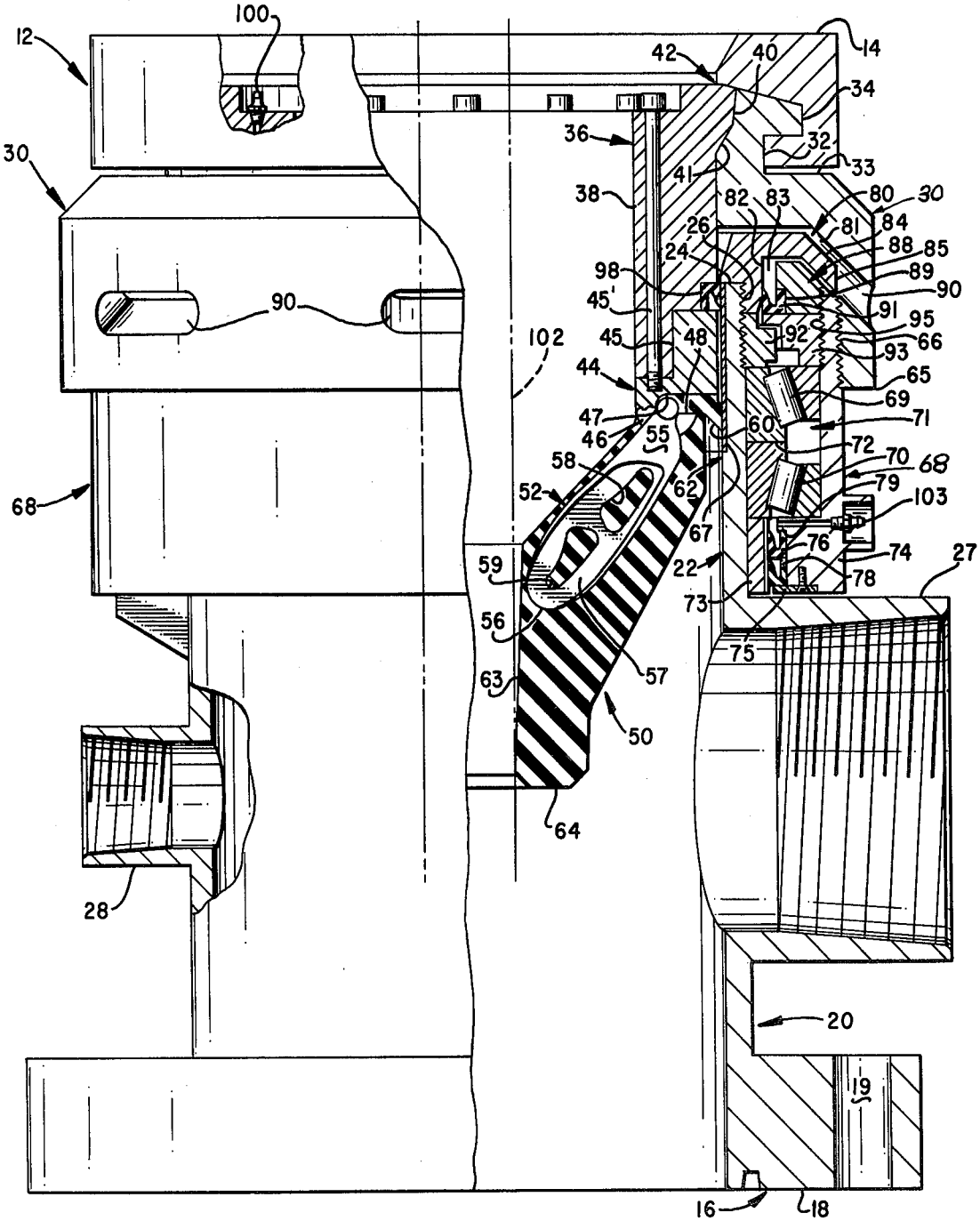
FIG. 2 is an enlarged, longitudinal, cross-sectional view of the rotating blowout preventor disclosed in FIG. 1.
Figure 3:
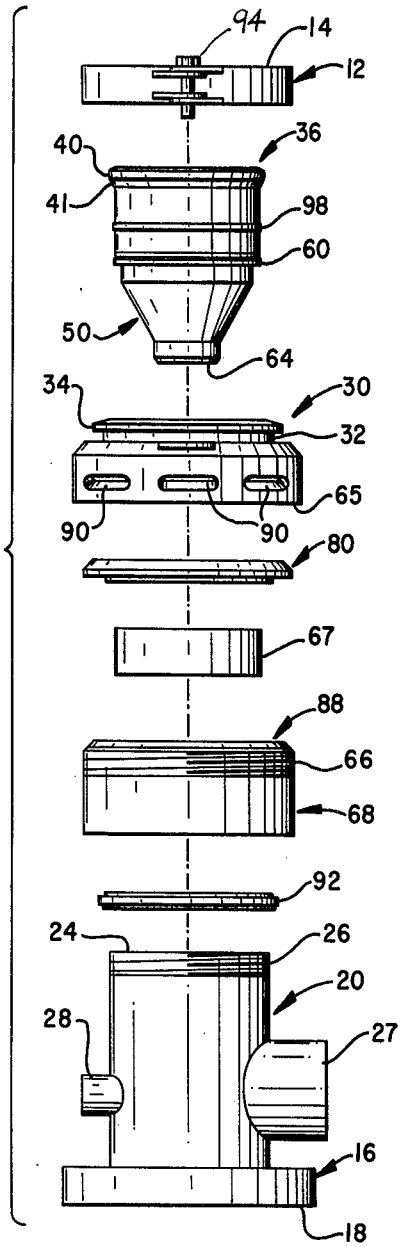
FIG. 3 is an exploded view of the rotating blowout preventor disclosed in FIG. 1.
Figure 4:
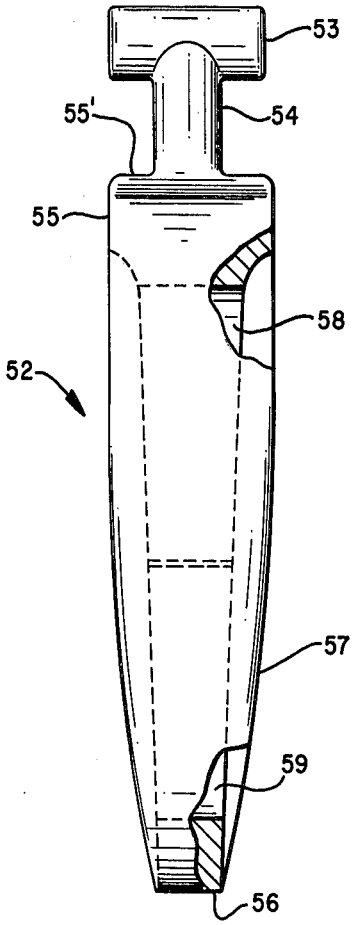
FIG. 4 is a detail of part of the apparatus disclosed in the foregoing figures; and, FIG. 5 is a lateral, cross-sectional view of the stripper mount of FIG. 2, with some additional parts being removed to further illustrate some hidden details thereof.

In FIG. 2, a lug 42 is seen to be an extension of the doughnut. The lug engages the clamp gap of the two co-acting clamp halves to further prevent rotation of the stripper assembly. A stripper adaptor in the form of a bolt flange 11 is provided with an annular shoulder 45 which receives the doughnut in close tolerance relationship therewithin with bolts 45' extending downwardly through the doughnut and into the adaptor so that the stripper rubber can be easily removed from the doughnut. A female hinge element 46 is provided with a cavity 47 which outwardly opens at 48 so that a number of radially spaced apart pairs of fingers can be hingedly mounted within the cavity 47 with the fingers and the stripper adaptor all being vulcanized to the stripper rubber 50.

Figure 5:
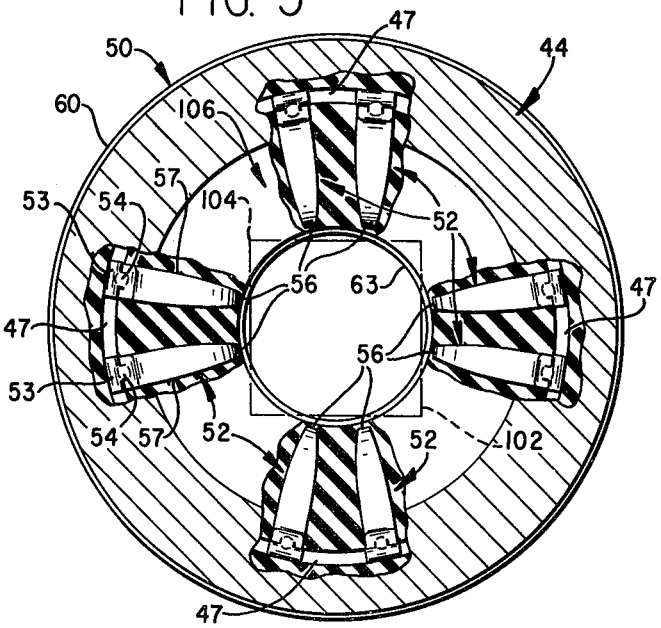

As seen in FIGS. 2 and 5, the fingers 52 are provided in pairs with the number of pairs being equal to the number of sides employed on the kelly. The fingers have a male hinge end 53 which is captured in a journaled manner within the before mentioned cavity 47 with the neck 54 being received in a cutout formed through portion 46 so that the enlargement at 55' bears against the lower curved circumferentially extending member at 46.

The finger extends down into and is vulcanized within the rubber, with the fingers terminating at free end 56. Ribs 57 are formed on either side of the finger while voids 58 and 59 form lightening holes so that rubber compound fills the voids thereby more efficiently bonding the fingers within the main annular body of rubber.

As seen in FIG. 5, the fingers are arranged in radially spaced pairs placed about the stripper bolt flange in close proximity to the inside surface of the stripper rubber.

The outturned rubber piece 60 sealingly engages the inside peripheral wall surface 62 of the washpipe 22, thereby forming a debris barrier which prevents ingress of debris into the area 61 located between the washpipe and stripper bolt flange.

The inside diameter of the stripper rubber sealingly engages a drive member in an unusual manner as indicated in FIG. 5, so that sufficient force can be transferred from the kelly into the rotating head. The stripper rubber terminates at 64.

The skirt member includes an upper marginal portion having a lower edge 65. The upper marginal portion threadedly engages the lower marginal end portion at 66. Hence, the threaded area 66 enables the two members 30 and 68 of the rotating head assembly to be assembled.

Upper bearing 69 and lower bearing 70 abuttingly engage one another at interface 72 and are loated within the located bearing and seal chamber 71. The lower bearing inner race is supported by an annular bearing support member 73 which is spaced from an inwardly directed circumferentially extending boss 74 formed on the inner marginal end portion of the skirt 68. Annular plate member 75 forms a keeper and is removably affixed to the boss 74 for properly positioning the lower seal assembly 76 and 78 within the illustrated lower seal chamber. The boss includes an inwardly directed lip 79 against which the upper seal 76 is abuttingly received thereby capturing the two seals 76 and 78 between members 75 and 79.

Stationary annular ramada 80 forms a slinger ring and is located in overlying relationship respective to the upper end portion of the bearing and seal chamber and is spaced from the rotating head assembly to form annular chamber 81. The ramada has a polished surface 82 which forms part of a cavity 83. The ramada outwardly and downwardly slopes at 84 and terminates at 85 in close proximity to a plurality of radial outlet ports 90. An upper, outer nut 88 is provided with a seal receiving annular groove 89 within which an upper seal assembly 91 is mounted. Lower, inner nut 92 is provided with a left hand thread for engaging the lower left hand threaded portion of the threaded surface 26. Lower, outer, left hand nut 93 is similarly provided with a left hand thread for engaging the lower left hand threaded portion of a threaded area at 95.

Clamp hinge 94 provides a pivot for the two clamp halves, and when the clamp halves are brought together by the illustrated tension adjusting fastener means, a clamp gap 96 is left between the adjacent co-acting clamp halves.

A stripper seal 98 is interposed between the doughnut and adapter and wears against wear fixed sleeve 67. A grease fitting 100 provides lubricant for the stripper seal. Numeral 102 indicates a driving member, also called a kelly, which can be square, hexagon, or any other known configuration, as long as it conforms to the geometry of the spaced pairs of fingers of FIG. 5.

In operation, the rotating blowout preventor of the present invention is bolted to a stack of other tools located on top of a surface casing during the borehole forming operation, although the bolt flange 18 can equally well be utilized by being bolted directly to the casing if such an expedient be desired. The kelly 102 is run down through the axial passageway in the illustrated manner of FIG. 2 so that drilling mud flows down through the rotating kelly, through the drill string, to the bit, back up the casing annulus, through the outlet 27, and on to the mud bit.

As the kelly rotates, the rubber 50 accommodates the driving member in the unusual manner of FIGS. 2 and 5 with the rubber stripper assembly rotating therewith and driving the rotating head assembly. Threaded surface 66 is a right handed thread and tends to be tightened during the drilling operation. The loads imposed upon the stripper assembly are transferred into the rotating head assembly with the upper bearing 69 normally taking most of the load while going into the hole unless the pressure in proximity of the stripper rubber is unduly high, whereupon the lower bearing would carry most of the reversed load.

Should leakage occur across debris barrier 60 and stripper seal 98, flow of contaminates will continue into the annular passageway 81 and out through ports 90, with the relative movement between member 88 and the slinger ring 80 preventing debris from entering the close tolerance interface at 86. Hence, the chamber 71, which houses the bearings and seals, is maintained free of contaminates. Lubricant at 103 is added to the chamber from time to time with the excess lubricant flowing past the upper seal 91 due to the assembled configuration of the upper and lower seal assemblies.

Should it become necessary to replace either the rubber or the primary seal, the clamp 12 is unfastened and the two halves pivoted away from one another, whereupon the entire seal assembly can be withdrawn from the rotating head assembly and repairs effected as may be required. Hence, it is unnecessary to remove the massive rotating head assembly from the stack.

Should a bearing or seal associated with the bearing chamber become doubtful, the entire rotating head assembly can be easily entered for repairs and maintenance by locking the cylinder 68 and rotating the upper end of the rotating head assembly, thereby unthreading the surface 66, whereupon the stripper rubber assembly, along with the clamp and upper end of the rotating head assembly, can be lifted free of the main body, thereby exposing the slinger ring.

Next, the slinger ring, which has a left handed thread, is removed, thereby gaining access to nut 88 which is a right handed nut. Nut 88 is removed, thereby gaining access to seal 91. The left handed nut 92 and left handed nut 93 are next removed, whereupon the bearing and lower seal assembly may be replaced as might be required.

The rubber of the present seal assembly is affixed to the stripper bolt flange or adaptor in a novel and improved manner by the provision of the before mentioned fingers which individually extend down into the massive rubber body and transmit loads between the rubber and the stripper bolt flange in a new and improved manner so that the combination enjoys a long and satisfactory service life, and provides a novel means by which the low friction rotating head is turned by the kelly.

The number of pairs of fingers 52 of FIG. 5 are equal to the number of sides presented by the driving member. Four pairs of fingers are shown for illustrative purposes in FIG. 5, with the driving member 102 having four corresponding corners at 104 which resistingly turn towards an adjacent pair of fingers, with the resisting force provided by the fingers being adequate for imparting rotation into the head. Stated differently, the corners 104 of kelly 102 cannot pass beyond the pairs of fingers and therefore develop a torque which imparts rotational motion into the rotating parts of the rotating blowout preventor.

I claim:

1. A rotating blowout preventor having a main body, a longitudinal extending axial passageway formed therethrough through which a driving member can be received; said main body includes an inner fixed sleeve;

a rotatable stripper assembly which includes a stripper rubber for sealingly receiving a longitudinally extending driving member in axial slidable relationship therewith; a stripper mount body to which said stripper rubber is affixed, the lower marginal end of said stripper assembly being of a configuration to be rotatably received within the upper marginal end of said main body, a stripper seal means located between said stripper mount body and said inner fixed sleeve for precluding flow of drilling fluid therethrough;

a rotatable, load carrying outer skirt member axially aligned with said axial passageway and spaced outwardly from said inner fixed sleeve, and having the upper end thereof removably affixed to said stripper mount body to form a bearing housing therebetween; an upper and a lower bearing means axially aligned with one another and with said axial passageway and transferring any load from said load carrying outer skirt member into said inner fixed sleeve; upper and lower seal means located within each opposed end of said bearing housing at a location above said upper and below said lower bearing means to isolate the bearing housing from contamination;

and means associated with said stripper assembly for enabling a driving member to impart rotational motion thereinto which causes said load carrying outer skirt member to rotate while said load carrying outer skirt member is being rotatably supported by said upper and lower bearing means; said means associated with said stripper assembly includes a plurality of radially spaced reinforcement means which are an integral part of said stripper rubber and arranged respective to one another such that a driving member having a cross-sectional configuration in the form of a polygon will present the corners thereof within the stripper rubber at a location between adjacent ones of said reinforcement means to thereby apply a rotational force into the stripper rubber of a magnitude which imparts rotational motion into said stripper assembly.

2. The rotating blowout preventor of claim 1 wherein said rotatable load carrying outer skirt member includes a circumferentially extending flange member at the upper end thereof which downwardly depends in concentric relationship respective to said inner fixed sleeve and thereby forms a downwardly opening chamber which is said bearing housing;

a slinger ring affixed to said inner fixed sleeve and having a circumferentially extending edge portion outwardly extending into overlying relationship respective to part of said outer skirt member to form an annular chamber;

radial ports formed in said outer skirt member, an annular area formed between said flange and said slinger ring which communicates with said radial ports so that any fluid which inadvertently leaks through said stripper seal means will be conducted along said annular area and out of said radial ports.

3. The apparatus of claim 2 wherein said outer skirt member includes a separate, lower marginal free end portion in the form of a cylinder which threadedly engages the upper marginal end of said outer skirt member;

said slinger ring has an inner threaded portion which threadedly engages said inner fixed sleeve;

so that when said stripper mount body is rotated respective to said cylinder, the upper end of the outer skirt member is unscrewed from said cylinder, and the upper end of the outer skirt member, along with the stripper assembly and clamp, can be lifted from said main body.

4. The rotating blowout preventor of claim 1 wherein an abutment is formed on the upper marginal end of said seal and bearing housing against which the outer race of said upper bearing is received, an annular groove formed in said abutment for receiving said upper seal means therein;

said load carrying skirt member includes a circumferentially extending flange member at the upper end thereof, said load carrying skirt and said inner fixed sleeve are spaced apart and thereby form a downwardly opening chamber which is said bearing and seal housing;

a slinger ring affixed to said inner fixed skirt and having a circumferentially extending edge portion outwardly extending into overlying relationship respective to said outer skirt member to form an annular chamber; and, radial ports formed in said outer skirt member which communicate with the annular area formed between said flange and said slinger ring so that any fluid which inadvertently leaks through said stripper seal means and said upper seal means will be conducted out of said radial port.

5. The rotating blowout preventor of claim 1 wherein said load carrying skirt member includes a circumferentially extending flange member at the upper end thereof, said load carrying skirt member and said inner fixed sleeve are concentrically arranged respective to one another to thereby form a downwardly and upwardly opening chamber which is said bearing housing; said upper seal means closing the upper end of said chamber;

a slinger ring affixed to said inner fixed skirt and having a circumferentially extending edge portion outwardly extending into overlying relationship respective to said upper seal means and with respect to part of said outer skirt member to form a laterally disposed annular chamber between said outer skirt member and said slinger ring;

radial ports formed in said outer skirt member which communicate with the annular area formed between said flange and said slinger ring so that any fluid which inadvertently leaks through said stripper seal means and through said upper seal means will be conducted along said annular area and out of said radial ports;

said stripper mount body includes an outwardly directed lug formed about the outer peripheral surface thereof, a groove formed in said load carrying outer skirt member and spaced from and concentric with the lug, a clamp means having an inside surface made complementary with the before recited spaced lug and groove so that the clamp means affixes said stripper mount body to said outer skirt member;

whereupon said clamp can be removed from attached relationship respective to said stripper mount means and said load carrying outer skirt member to enable the stripper assembly to be lifted free of said outer skirt member.

6. The rotating blowout preventor of claim 1 wherein said stripper mount body includes an outwardly directed lug formed about the outer peripheral surface thereof, a groove formed in said load carrying outer skirt member and spaced from and concentric with said lug, a clamp means having an inside surface made complementary with the before recited spaced, concentric lug and groove so that the clamp means affixes said stripper mount body to said outer skirt member;

whereupon said clamp can be removed from attached relationship respective to said stripper mount body and said load carrying outer skirt member so that the stripper assembly can be lifted free of said outer skirt member.

7. The rotating blowout preventor of claim 1 wherein said stripper rubber is affixed to a stripper bolt flange, said reinforcement means includes a hinge element formed on a lower end portion of said bolt flange and a plurality of elongated fingers having a hinged end and a lower end spaced therefrom, said hinged end being hingedly affixed to said hinge element such that the fingers are each pivotally affixed to said bolt flange in radially spaced relationship respective to one another and to said axial passageway;

said fingers being circumferentially spaced apart from one another and arranged to receive a kelly therebetween in the before described manner to thereby apply a torque to the stripper rubber and the fingers of a magnitude which imparts rotational motion into said rotatable stripper assembly.

8. The rotating blowout preventor of claim 1 wherein said stripper rubber is an assembly which includes a stripper flange member by which the stripper rubber is removably mounted to said lower end of said rotatable stripper assembly;

said reinforcement means include a plurality of spaced, elongated, metal reinforcements having a hinged end and a pivoted end, means pivotally mounting said hinged end of said metal reinforcements to said stripper flange such that the metal reinforcements can transfer torque into said stripper flange, and the pivoted end of the metal reinforcements extend downwardly and inwardly towards one another and concentrically respective to said axial passageway;

said metal reinforcements being vulcanized within said stripper rubber; the circumferential spacing of the metal reinforcings being such that the corners of a kelly are forcibly received therebetween to transmit torque from the kelly into the stripper rubber assembly, thereby imparting a rotational motion into the stripper assembly as in the before described manner.

9. A rotating blowout preventor having a main body member, a rotating head assembly, and an external bearing housing having bearings isolated therein which rotatably support said head assembly;

said rotating head assembly includes a stripper assembly which is removably received therewithin, and a downwardly depending skirt member;

said main body member includes an upwardly extending fixed washpipe which supports said bearing housing externally thereof, and which receives said stripper assembly therewithin; seal means formed between said washpipe and said stripper assembly to preclude fluid flow uphole therethrough;

an outflow pipe formed in said main housing in underlying relationship respective to said stripper assembly and arranged for flow to occur laterally therefrom;

the walls of said bearing housing being the outside wall of said washpipe and the inside wall of said skirt member; upper and lower seal means, respectively, closing the upper and lower ends, respectively, of said bearing chamber;

a fixed plate of annular construction affixed to the upper end of said washpipe and spaced from said rotating head assembly to form an annulus therebetween, radially spaced passageways formed in said rotating head which flow communicates said annulus with ambient;

said stripper assembly includes a stripper rubber having load transferring members embeded therein in radially spaced relationship respective to one another, with adjacent load transferring members being arranged to receive the corner of a kelly drive member therebetween so that the kelly can impart rotational motion into the stripper assembly, thereby rotating the rotating head assembly.

10. The rotating blowout preventor of claim 9 wherein said stripper assembly includes a stripper flange member, means by which the stripper rubber is removably mounted to said stripper flange member, means by which said stripper flange member is mounted to the lower end of said stripper assembly;

said load transferring members include a plurality of spaced, elongated, metal reinforcements having a hinged end and a pivoted end, means pivotally mounting said hinged end of said metal reinforcements to said stripper flange member such that the metal reinforcements can transfer torque into said stripper flange member and the pivoted end of the metal reinforcements extend downwardly and inwardly towards one another and concentrically respective to said axial passageway;

said metal reinforcements being vulcanized within said stripper rubber; the circumferential spacing of the metal reinforcements being arranged geometrically such that the corners of a kelly of similar geometry are forcibly received therebetween to transmit torque from the kelly into the stripper rubber, thereby imparting a rotational motion into the stripper assembly.

11. The rotating blowout preventor of claim 9 wherein said rotatable, load carrying skirt member includes a circumferentially extending flange member at the upper end thereof, which downwardly depends in concentric relationship respective to said fixed washpipe and thereby forms a downwardly opening chamber which is said bearing housing;

a slinger ring affixed to said fixed washpipe and having a circumferentially extending edge portion outwardly extending into overlying relationship respective to part of said outer skirt member to form an annular chamber;

radial ports formed in said outer skirt member which communicate with the annular chamber so that any fluid which inadvertently leaks through said seal means will be conducted along said annular area and out of said radial ports.

12. The rotating blowout preventor of claim 9 wherein said skirt member includes a separate, lower marginal free end portion in the form of a cylinder which threadedly engages the upper marginal end of said skirt member;

said slinger ring has an inner threaded portion which threadedly engages said washpipe;

so that when said stripper assembly is rotated respective to said cylinder, the upper end of the outer rotating member is unscrewed and the upper end of the outer rotating member can be lifted along with the stripper assembly and clamp.

13. A rotating blowout preventor having a main body member by which it can be attached to the upper end of a cased wellbore; a rotating head assembly rotatably supported by said main body member, a stripper rubber, mount means by which said stripper rubber is attached to the lower end of said rotating head assembly; said main body member, rotating head assembly, and said stripper rubber being axially aligned with one another with said stripper rubber being adapted to sealingly engage a driving member which slidably extends therethrough; an outlet formed in said main body member at a location which enables flow to occur from the annulus formed about said stripper rubber laterally away from said main body member;

means included in said stripper rubber by which a driving member transfers torque into said stripper rubber and thereby rotates said rotating head assembly; the last said means includes a plurality of spaced, elongated, metal reinforcements having a fixed end and a pivoted end; means mounting said fixed end of said metal reinforcements to said mount means such that the metal reinforcements can transfer torque into said mount means and the pivoted end of said metal reinforcements extend downwardly and inwardly towards one another and concentrically respective to the axial passageway thereof;

said metal reinforcements being vulcanized within said stripper rubber; the circumferential spacing of said metal reinforcements being such that the corners which define the ends of the adjacent sidewalls of a kelly are forcibly received therebetween to transmit torque from the kelly into the stripper rubber assembly, thereby imparting a rotational motion into the rotating head assembly.

14. The rotating blowout preventor of claim 13 wherein said mount means is a flange assembly to which said stripper rubber is vulcanized, fastener means by which said flange assembly is removably affixed to said rotating head assembly, a circumferentially outwardly opening groove formed in said flange assembly, an enlargement formed on the fixed end of said metal reinforcements, said enlargement is captured within said groove such that the groove and enlargement form a hinge, thereby enabling one end of the reinforcements to be pivoted about the other end thereof.

15. A rotating blowout preventor having a main body, a longitudinal extending axial passageway formed therethrough through which a driving member can be received; said main body includes an inner fixed sleeve;

a rotatable stripper assembly which includes a stripper rubber for sealingly receiving a longitudinally extending driving member in axial slidable relationship therewith; a stripper mount body to which said stripper rubber is affixed, the lower marginal end of said stripper assembly being rotatably received within the upper marginal end of said main body, a stripper seal means located between said stripper mount body and said inner fixed sleeve for precluding flow of drilling fluid therethrough;

a rotatable load carrying outer skirt member axially aligned with said axial passageway and spaced outwardly from said inner fixed sleeve, and having the upper end thereof removably affixed to said stripper mount body to form a bearing housing therebetween, an upper and a lower bearing means axially aligned with one another and with said axial flow passageway and transferring any load from said load carrying outer skirt member into said inner fixed sleeve; upper and lower seal means located within each opposed end of said bearing housing at a location above said upper and below said lower bearing means to isolate the bearing housing from contamination;

said rotatable load carrying outer skirt member includes a circumferentially extending flange member at the upper end thereof, which downwardly depends in concentric relationship respective to said inner fixed sleeve and thereby forms a downwardly opening chamber which is said bearing housing;

a slinger ring affixed to said inner fixed sleeve and having a circumferentially extending edge portion outwardly extending into overlying relationship respective to part of said outer skirt member to form an annular chamber;

radial ports formed in said outer skirt member which communicate with an annular area formed between said flange member and said slinger ring so that any fluid which inadvertently leaks through said stripper seal means will be conducted along said annular area and out of said radial ports;

and means associated with said stripper assembly for enabling a driving member to impart rotational motion thereinto which causes said load carrying outer skirt member to rotate while being rotatably supported by said upper and lower bearing means.

16. The apparatus of claim 15 wherein said outer skirt member includes a separate, lower marginal free end portion in the form of a cylinder which threadedly engages the upper marginal end of said outer skirt member;

said slinger ring has an inner threaded portion which threadedly engages said inner fixed sleeve;

so that when said stripper assembly is rotated respective to said cylinder, the upper end of the outer skirt member is unscrewed from the cylinder and the upper end of the outer skirt member can be lifted from the main body along with the stripper assembly.

17. A rotating blowout preventor having a main body member, a rotating head assembly, and an external bearing chamber having bearing means isolated therein for rotatably supporting said head assembly;

said rotating head assembly includes a stripper assembly which is removably received therewithin, and a downwardly depending skirt member;

said main body member includes an upwardly extending fixed washpipe which supports said bearing chamber externally thereof, and which receives said stripper assembly therewithin; seal means formed between said washpipe and said stripper assembly for precluding fluid flow in an uphole direction therethrough;

an outflow pipe attached to said main body in underlying relationship respective to said stripper assembly and arranged for flow to occur laterally therefrom;

the walls of said bearing chamber are also the outer wall of said washpipe and the inner wall of said skirt member; upper and lower seal means, respectively, closing the upper and lower ends, respectively, of said bearing chamber;

a fixed plate of annular construction affixed to the upper end of said washpipe and spaced from said rotating head assembly to form an annulus therebetween, radially spaced passageways formed in said rotating head assembly which flow communicates said annulus with the ambient;

said skirt member includes a separate, lower marginal free end portion in the form of a cylinder which threadedly engages the upper marginal end of said skirt member; a slinger ring having an inner threaded portion which threadedly engages said fixed washpipe; so that when said stripper assembly is rotated respective to said cylinder, an upper end portion of the skirt member is unscrewed, and the upper end of the skirt member can be lifted along with the stripper assembly from the main body member.

* * * * *